US005116238A

United States Patent [19]

Holloman

[11] Patent Number: 5,116,238

[45] Date of Patent: May 26, 1992

[54] REUSEABLE ELECTRICAL CONNECTOR

[76] Inventor: Sammy Holloman, 221 Floyd Golden Cir., Portales, N. Mex. 88130

[21] Appl. No.: 726,212

[22] Filed: Jul. 5, 1991

[51] Int. Cl.[5] ..... H01R 4/24

[52] U.S. Cl. ..... 439/441

[58] Field of Search ..... 439/436–441, 439/692–695

[56] References Cited

U.S. PATENT DOCUMENTS

| | | | |
|---|---|---|---|
| 2,779,828 | 1/1957 | Despard . | |
| 2,873,433 | 2/1959 | Despard . | |
| 2,890,436 | 6/1959 | Bentley . | |
| 2,983,894 | 5/1961 | Lawson et al. | 439/436 |
| 3,015,877 | 1/1962 | Francis | 439/693 |
| 3,093,434 | 6/1963 | Francis | 439/694 |
| 3,255,428 | 6/1966 | Robbins . | |
| 3,284,754 | 11/1966 | Buchanan | 439/436 |
| 3,383,640 | 5/1968 | Godziemba-Dambski . | |
| 3,936,126 | 2/1976 | Miller . | |
| 4,759,725 | 7/1988 | Finch . | |
| 4,824,395 | 4/1989 | Blaha | 439/438 |

*Primary Examiner*—Joseph H. McGlynn
*Attorney, Agent, or Firm*—Craig A. Wood

[57] ABSTRACT

A reuseable electrical connector is disclosed for providing electrical and physical connection between electrical wires. An electrically conductive concave plate of generally triangular cross-section, having wire entry holes disposed along one side and generally opposing gripping edges disposed opposite to the holes is enclosed within an electrically insulating exterior portion.

12 Claims, 3 Drawing Sheets

REUSEABLE ELECTRICAL CONNECTOR

BACKGROUND OF THE INVENTION

1. Field of the Invention

The use of solderless, reuseable electrical connectors is increasing with respect to all types of electrical equipment, and is especially advantageous with respect to operations where the time involved in producing electrical connections is a significant factor. The present invention generally relates to electrical connectors, and more particularly concerns quick connect and disconnect, solderless, reuseable electrical connectors of the plug-in type.

2. Description of the Prior Art

A number of solderless, reuseable electrical connectors are presently available, for instance, the popular wire lock nut type. In addition, devices that utilize solderless, reuseable electrical connectors are disclosed by U.S Pat. Nos. 2,779,828; 2,873,433; 2,890,436; 3,255,428 and 3,383,640, and devices showing single use, solderless electrical connectors are disclosed by U.S. Pat. Nos. 3,936,126 and 4,759,725. The reuseable devices recently becoming available have tended to have a relatively large number of components, thereby increasing the cost and difficulty of use, and frequently require the use of a separate tool in order to cause removal of a wire from the electrical connector. Moreover, these devices typically require that a significant amount of insulation must be stripped from the end of each wire prior to connection.

Despite the availability of such devices, there exists a need in the art for an inexpensive and relatively simple electrical connector that is capable of rapid and repeated use, without needing a separate removal tool, yet also facilitates electrical fault tracing by permitting individual wires to be removed from connection.

SUMMARY OF THE INVENTION

In order to aid in the understanding of the present invention, it can be stated in essentially summary form that it is directed to a electrical connector that is capable of repeated use in quickly connecting and disconnecting wires using a minimum number of tools and with a minimum amount of preparation to the wires.

It is an object of the present invention to provide a reuseable electrical connector that provides strong physical and electrical connections between wires.

It is another object of the present invention to provide a reuseable electrical connector that is capable of rapid use with a minimum number of tools.

It is another object of the present invention to provide a reuseable electrical connector that is capable of use with a minimum amount of preparation to wires.

It is another object of the present invention to provide a reuseable electrical connector that provides a high degree of electrical insulation with respect to the surrounding environment.

It is another object of the present invention to provide a reuseable electrical connector that is small in size.

It is still another object of the present invention to provide a reuseable electrical connector that is inexpensive to produce.

It is yet another object of the present invention to provide a reuseable electrical connector of relatively simple construction with a minimum of components.

Further objects and advantages of the present invention will be apparent from a study of the following portion of the specification, the claims, and the attached drawings.

DESCRIPTION OF THE PREFERRED EMBODIMENT

The following portion of the specification, taken in conjunction with the drawings, sets forth the preferred embodiment of the present invention. The embodiment of the invention disclosed herein is the best mode contemplated by the inventor for carrying out his invention in a commercial environment, although it should be understood that various modifications can be accomplished within the parameters of the present invention.

Figure 1:
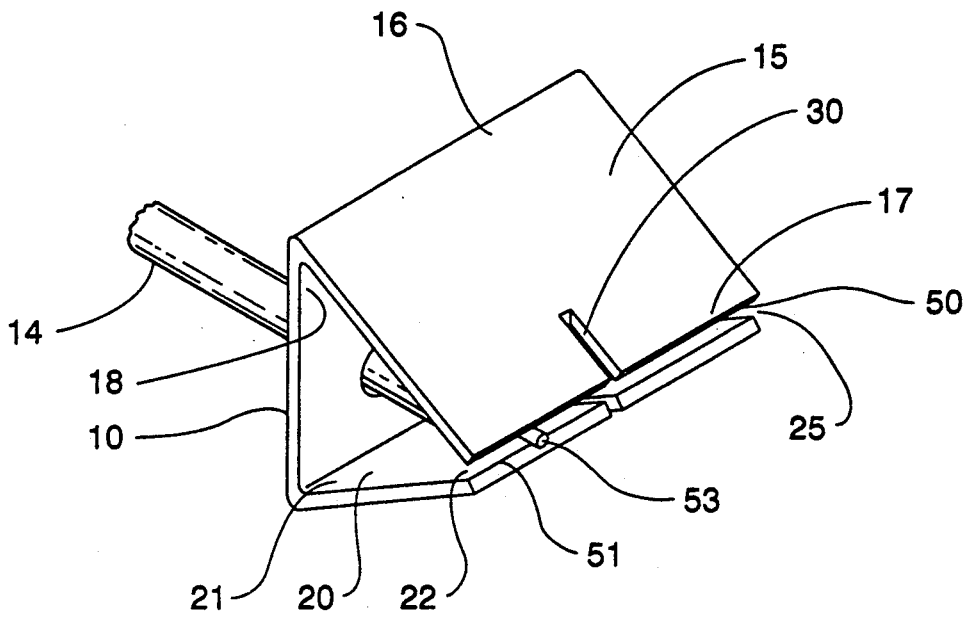
FIG. 1 is a front perspective view of the interior portion of an reuseable electrical connector representing the present invention with one wire inserted.
Figure 2:
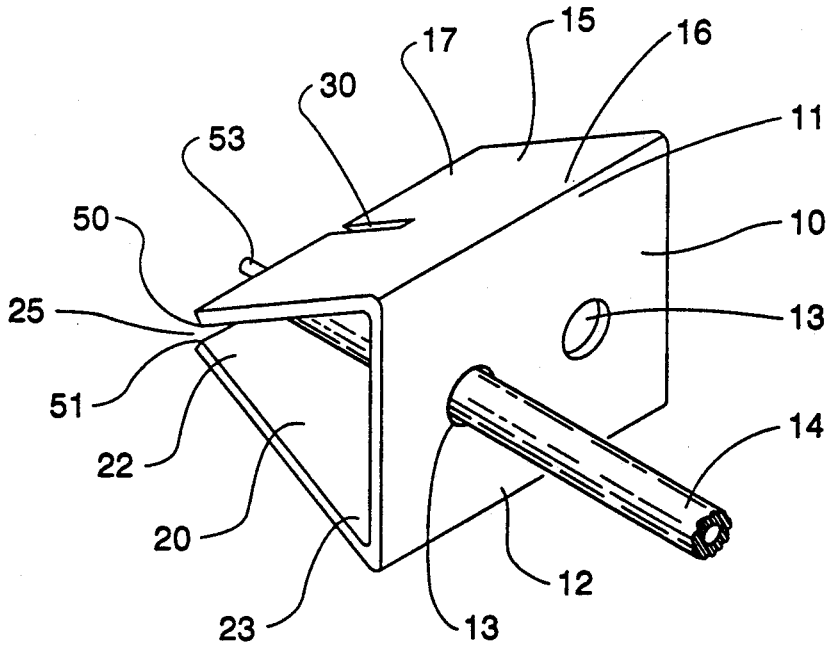
FIG. 2 is a rear perspective view of the interior portion of an reuseable electrical connector representing the present invention with one wire inserted.
Figure 3:
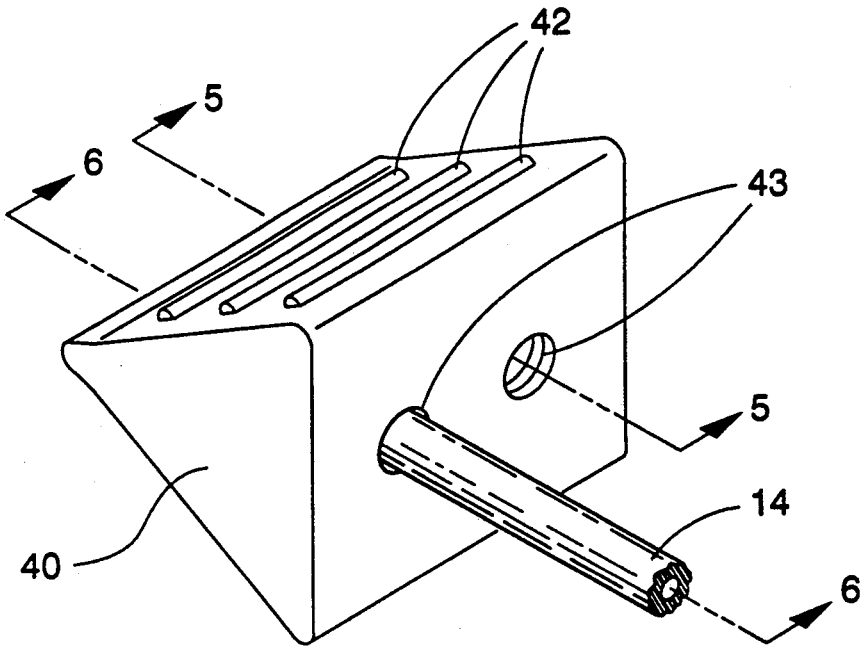
FIG. 3 is a front perspective view of the exterior of an reuseable electrical connector representing the present invention with one wire inserted.
Figure 4:
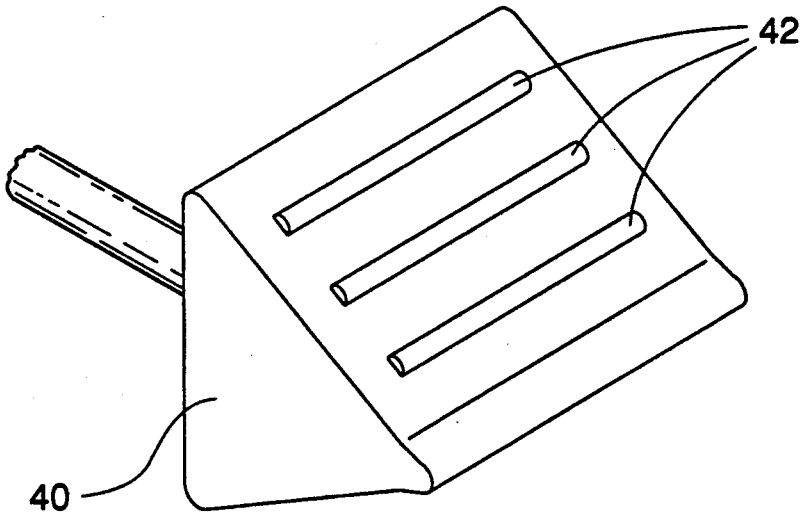
FIG. 4 is a rear perspective view of the exterior of an reuseable electrical connector representing the present invention with one wire inserted.

Referring now to the drawings for a detailed description of the present invention in the instance of connection of two wires, reference is first made to FIGS. 1 and 2, depicting generally rectangular base plate 10 having base plate first and second longer sides 11 and 12, and having wire entry holes 13 disposed longitudinally along, bisecting and through base plate 10. Insulated wire 14 is shown in place as projecting through one of wire entry holes 13.

As depicted in FIG. 1 and 2, generally rectangular first gripping plate 15 having first gripping plate first and second longer sides 16 and 17 is integrally formed with base plate 10 so that first gripping plate first longer side 16 is disposed along and parallel to base plate first longer side 11, forming a first acute angle 18 with respect to base plate 10. First acute angle 18 is chosen so that first gripping plate 15 does not intersect a plane normal to and bisecting base plate 10 and parallel with base plate first and second longer sides 11 and 12, and so that first gripping plate second longer side 17 separated from said plane by a small amount as hereinafter described.

In a similar manner, generally rectangular second gripping plate 20 having second gripping plate first and second longer sides 21 and 22 is integrally formed with base plate 10 so that second gripping plate first longer side 21 is disposed along and parallel to base plate second longer side 12, forming second acute angle 23 with respect to base plate 10. Second acute angle 23 is chosen so that second gripping plate 20 does not intersect the plane normal to and bisecting base plate 10 and parallel with base plate first and second longer sides 11 and 12, with second gripping plate second longer side 22 separated from said plane by a small amount as hereinafter described.

Figure 5:
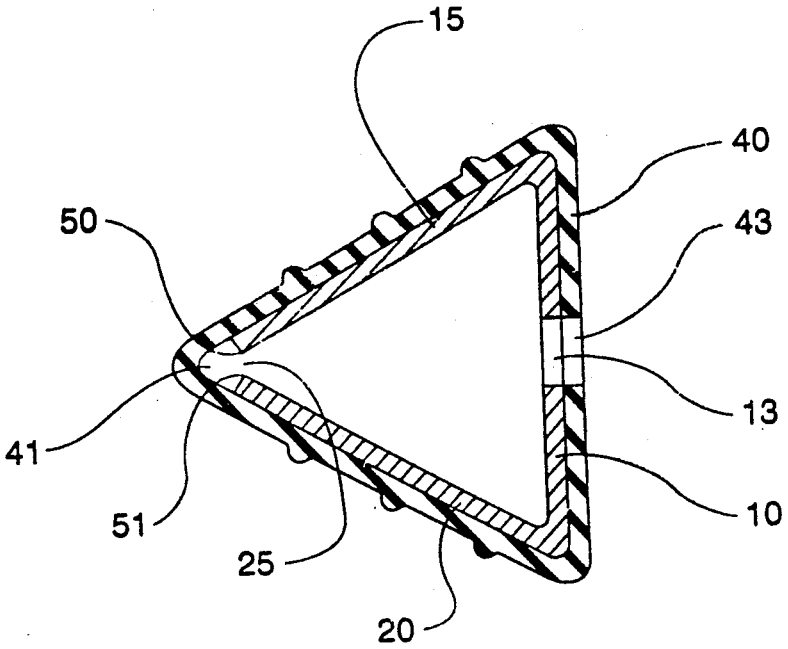
FIG. 5 is a section view taken along line 5—5 of FIG. 3.
Figure 6:
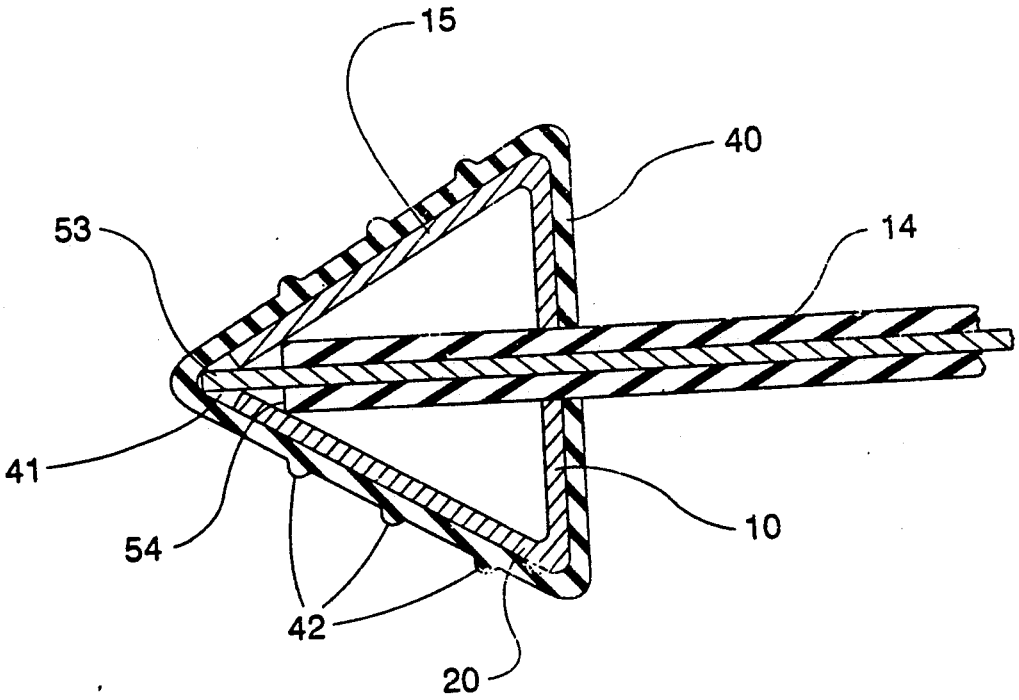
FIG. 6 is a section view taken along line 6—6 of FIG. 3.

Longitudinal slot 25 is defined by first gripping plate second longer side 17 and second gripping plate second longer side 22. In this manner, as shown in FIGS. 5 and 6, base plate 10 and first and second gripping plates 15 and 20 form a concave channel of generally triangular cross-section with slot 25 disposed at one vertex of the triangular cross-section. Typically, the triangular cross-section is approximately equilateral, so that first and second acute angles 18 and 23 are each approximately 60 degrees.

In addition to integral formation of base plate 10 with first and second gripping plates 15 and 20, it is clear that first and second gripping plates 15 and 20 may also be separate elements and attached to base plate 10, for instance, by welding.

FIG. 5 depicts the present invention without the presence of a wire, with first gripping edge 50 disposed at first gripping plate second longer side 17, and similarly second gripping edge 51 disposed at second gripping plate second longer side 22. FIG. 6 depicts the present invention with wire 14 present. First and second gripping edges 50 and 51 are in gripping contact with wire core 53, and wire insulation end 54 is in contact with the interior surfaces of first and second gripping plates 15 and 20. First and second gripping plates 15 and 20 have opposing transverse isolation notches 30 disposed perpendicular to first and second gripping plate second longer sides 17 and 22, and aligned between each pair of wire entry holes 13.

Base plate 10, first gripping plate 15 and second gripping plate 20 are formed from an electrically conductive, hard, resilient material such as spring steel. In addition, base plate 10, first gripping plate 15 and second gripping plate 20 may economically be formed from a single piece of conductive, resilient material thereby increasing strength and simplifying fabrication.

As shown in FIGS. 3, 4, 5 and 6, electrically insulating cover 40, having wire core acceptance cavity 41, longitudinal ribs 42, and access holes 43 of substantially the same size as wire entry holes 13, is disposed so as to surround base plate 10 and first and second gripping plates 15 and 20, with one of access holes 43 coincident with each of wire entry holes 13. Insulated wire 14 is shown in place as projecting through one of access holes 43.

Although the present invention has been described in the case where two wires are to be connected, it will be understood that a larger number of wires may be connected by the present invention by forming base plate 10 to have greater longitudinal extent as dictated by the required number of wire entry holes 13, and with first and second gripping plates 15 and 20 similarly extended and the number of transverse isolation notches 30 correspondingly increased. Additionally, although the cross-section defined by base plate 10 and first and second gripping plates 15 and 20 has been described as triangular, it will be understood that other cross-sections may be utilized.

In use, where the temperature of wire insulation is approximately 60 degrees Fahrenheit or above, wire that has not been stripped of insulation may be connected to the present invention as follows. Wire 14 is inserted through an access hole 43 and wire entry hole 13 until wire insulation end 54 comes into contact with the interior surfaces of first and second gripping plates 15 and 20. Continuing to press wire 14 through wire entry hole 13, wire core 53 slightly extends beyond wire insulation end 54 and comes into contact with first and second gripping edges 50 and 51. Thereafter, electrical and physical connection of wire 14 is achieved by continuing to apply pressure to wire 14 accompanied by a slight twisting motion of wire 14 about the axis of wire 14, causing base plate 10 and first and second gripping plates 15 and 20 to locally slightly bend, and first and second gripping plates to locally rotate slightly with respect to base plate 10, that is, causing first and second acute angles 18 and 23 to locally slightly increase and slot 25 becomes locally slightly larger. In this way, wire core 53 is rotatably pushed through slot 25 in a screwing motion. As the material used in the core of electrical wires is typically only moderately hard, the resiliency of base plate 10 and first and second gripping plates 15 and 20, and the relative hardness of first and second gripping edges 50 and 51, causes first and second gripping edges 50 and 51 to slightly score the exterior of wire core 53, so that the rotating and pushing action on wire 14 causes wire 14 to be effectively screwed into physical and electrical connection with the present invention, with wire core 53 disposed in wire core acceptance cavity 41.

Notches 30 act to localize the motion of base plate 10 and first and second gripping plates 15 and 20 to a region near wire 14, thereby permitting any adjacent wires to remain undisturbed. In this way, insertion and removal of individual wires may be accomplished without affecting other wires that may be connected to the present invention, thereby permitting the rapid and efficient diagnosis of electrical faults.

To remove wire 14 from the present invention, pressure is applied to wire 14 so as to pull wire 14 out from wire entry hole 13, while simultaneously slightly twisting wire 14 in the opposite sense as before. Thus, wire 14 is effectively screwed out with respect to first and second gripping edges 50 and 51. As wire 14 is removed, the original orientation of base plate 10 and first and second gripping plates 15 and 20 is resumed.

Where the temperature of wire insulation 54 is below approximately 60 degrees Fahrenheit, wire insulation is in general sufficiently rigid so as to substantially restrict wire core 53 from extending beyond wire insulation end 54 as pressure is applied to wire 14. In such case it is necessary to strip a small amount of insulation from wire 14, thereby exposing approximately 1/16 inch of wire core 53 prior to insertion of wire 14 in the present invention.

Throughout wire insertion and removal operations, ribs 42 act to prevent slipping while grasping the present invention and applying pressure to wires.

The dimensions of the present invention are chosen so as to permit connection of wires of the desired gauge, that is, the diameter of wire entry holes 13 and access holes 43 are chosen to be greater than the outside diameter of the insulation of the wire sought to be connected, while the size of slot 25 is chosen to be slightly less that the outside diameter of the core of the wire to be connected. It will be understood that for each selection of dimensions of wire entry holes 13, access holes 43 and slot 25, a range of gauges of wires may be connected by the present invention, for the following reasons. Wires whose insulation has an exterior diameter somewhat less than the diameter of wire entry holes 13 and access holes 43 may easily pass through wire entry holes 13 and access holes 43, yet a high degree of electrical isolation is provided with respect to the outside world as a considerable length of insulated wire extends into the present invention as shown in FIG. 6. In addition, each size of slot 25 is capable of use with a range of wire core gauges as the base plate 10 and first and second gripping plates 15 and 20 are fabricated from material that is resilient, providing inward pressure against a wire core to maintain electrical and physical connection, yet permits a wire to slightly increase the size of slot 25 as it is placed in physical and electrical connection with the present invention.

The present invention having been described in its preferred embodiment, it is clear that it is susceptible to numerous modifications and embodiments within the ability of those skilled in the art and without the exercise of the inventive faculty. Accordingly, the scope of the present invention is defined by the scope of the following claims.

What is claimed is:

1. Reuseable electrical connector for wires having an electrically conductive core, comprising an electrically conductive, hard, resilient plate having two opposing parallel wire gripping edges, formed to a concave cross-section defining a uniform longitudinal slot between said edges, the width of said slot slightly smaller than the diameter of said core so that said edges may grip said core, a plurality of wire entry holes having diameter greater than the transverse dimension of said slot disposed through said plate and parallel to and opposing said slot, and a plurality of opposing paired notches disposed through said plate adjacent to and transverse to said slot so that one pair of said notches is disposed in a plane intermediate to each adjacent pair of said wire entry holes.

2. Reuseable electrical connector as defined in claim 1, further comprising means for electrically insulating the exterior of said plate so that said wire entry holes are physically unobstructed.

3. Reuseable electrical connector as defined in claim 2, wherein said plate is fabricated of spring steel.

4. Reuseable electrical connector as defined in claim 1, wherein said plate is formed to a uniform generally triangular cross-section with said slot disposed at a corner of the cross-section.

5. Reuseable electrical connector as defined in claim 4, further comprising means for electrically insulating the exterior of said plate so that said wire entry holes are physically unobstructed.

6. Reuseable electrical connector as defined in claim 5, wherein said plate is fabricated of spring steel.

7. Reuseable electrical connector as defined in claim 1, wherein said plate is formed to a uniform generally equilateral triangular cross-section with said slot disposed at a corner of the cross-section.

8. Reuseable electrical connector as defined in claim 7, further comprising means for electrically insulating the exterior of said plate so that said wire entry holes are physically unobstructed.

9. Reuseable electrical connector as defined in claim 8, wherein said plate is fabricated of spring steel.

10. Reuseable electrical connector for wires having an electrically conductive core, comprising:

an electrically conductive, resilient generally rectangular base plate having a plurality of wire entry holes disposed longitudinally along, bisecting and through said base plate;

an electrically conductive, resilient generally rectangular first gripping plate having first and second longer sides of substantially the same dimension as the longer sides of said base plate, first gripping edge disposed at said second longer side of said first gripping plate, and a plurality of first gripping plate notches disposed through said first gripping plate adjacent to and transverse to said second longer side of said first gripping plate with spacing corresponding to the spacing between said wire entry holes, attached to said base plate so that said first longer side of said first gripping plate is disposed along and parallel to a longer side of said base plate forming an acute angle with respect to said base plate so that said first gripping plate does not intersect the plane normal to and parallel with the longer sides of and bisecting said base plate, so that said second longer side of said first gripping plate is separated from said plane and said first gripping edge is disposed proximate to said plane, and so that one of said first gripping plate notches is disposed in a plane intermediate to each adjacent pair of said wire entry holes; and an electrically conductive, resilient generally rectangular second gripping plate having first and second longer sides of substantially the same dimension as the longer sides of said base plate, second gripping edge disposed at said second longer side of said second gripping plate, and a plurality of second gripping plate notches disposed through said second gripping plate adjacent to and transverse to said second longer side of said second gripping plate with spacing corresponding to the spacing between said wire entry holes, attached to said base plate so that said first longer side of said second gripping plate is disposed along and parallel to a longer side of said base plate forming an acute angle with respect to said base plate so that said second gripping plate does not intersect said plane, so that said second longer side of said second gripping plate is separated from said plane and said second gripping edge is disposed opposite to said first gripping edge, and so that one of said second gripping plate notches is disposed in a plane intermediate to each adjacent pair of said wire entry holes, defining a slot between said second longer sides of said first and second gripping plates edges, said slot having a width less than the diameter of said core so that said gripping edges may grip said core.

11. Reuseable electrical connector as defined in claim 10, further comprising means for electrically insulating said base plate, said first gripping plate and said second gripping plate so that said wire access holes are physically unobstructed.

12. Reuseable electrical connector as defined in claim 11, wherein said base plate and said first and second gripping plates are fabricated of spring steel.

* * * * *